United States Patent [19]

Gamez Duch

[11] 4,060,245

[45] Nov. 29, 1977

[54] SOCCER BOARD GAME

[76] Inventor: Enrique Gamez Duch, 10a Calle 3-02, Zona 1, Ciudad Guatemala, Guatemala

[21] Appl. No.: 709,132

[22] Filed: July 27, 1976

[30] Foreign Application Priority Data

July 28, 1975 Guatemala ..... 37842

[51] Int. Cl.[2] ..... A63F 9/00

[52] U.S. Cl. ..... 273/85 R; 273/95 E

[58] Field of Search ..... 273/85 R, 95 E

[56] References Cited

U.S. PATENT DOCUMENTS

| | | | |
|---|---|---|---|
| 1,145,457 | 7/1915 | Anderson | 273/95 E |
| 2,020,158 | 11/1935 | Oakes et al. | 273/85 R |

FOREIGN PATENT DOCUMENTS

| | | | |
|---|---|---|---|
| 513 of | 1906 | United Kingdom | 273/85 R |
| 341,651 | 1/1931 | United Kingdom | 273/85 R |
| 631,107 | 10/1949 | United Kingdom | 273/85 R |
| 25,270 of | 10/1906 | United Kingdom | 273/95 E |
| 292,176 | 6/1928 | United Kingdom | 273/85 R |
| 537,316 | 6/1941 | United Kingdom | 273/85 R |

*Primary Examiner*—Paul E. Shapiro

*Attorney, Agent, or Firm*—John J. Byrne; Edward E. Dyson

[57] ABSTRACT

A game having a soccer field layout, goals at each end thereof, player pieces to represent two soccer teams, a ball piece and a shooter disc for propelling one of said players against the ball piece to move the ball piece toward the goal whereby the rules of play of said game are designed to instruct in the rules of soccer and to entertain.

3 Claims, 14 Drawing Figures

SOCCER BOARD GAME

A principal objective of this invention is to provide a game that actually represents play on a soccer field and, at the same time, has mechanics of operation well within the skills of players sufficiently old enough to understand the rules of play.

Another objective of the invention is to provide a rugged and simple means for moving a ball piece forward and back between other players wherein skillful attempts at same will place the ball piece in the other team's goal.

Another objective of this invention is to provide shooter chip operating members of such a design that when skillfully utilized against a specially designed player piece, accurate movement is obtained without damage to the members or to the board itself.

A further objective of this invention is to provide a board game wherein the players are of a size to simulate and approximate the freedom and control of movement as in an actual soccer game.

These and other objects of the invention will become more apparent to those skilled in the art by reference to the following detailed description when viewed in light of the accompanying drawings wherein.

Figure 4A:
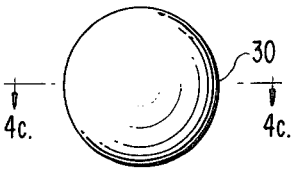
Figure 4B:
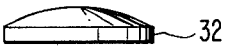
Figure 4C:
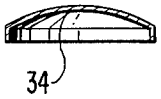
Figure 5A:
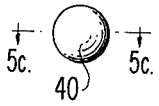
Figure 5B:
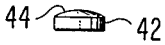
Figure 5C:
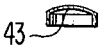
Figure 6A:
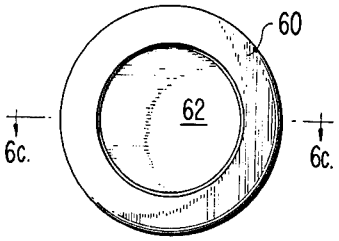
Figure 6B:
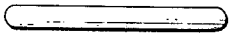
Figure 6C:
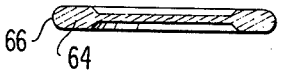
Figure 7A:
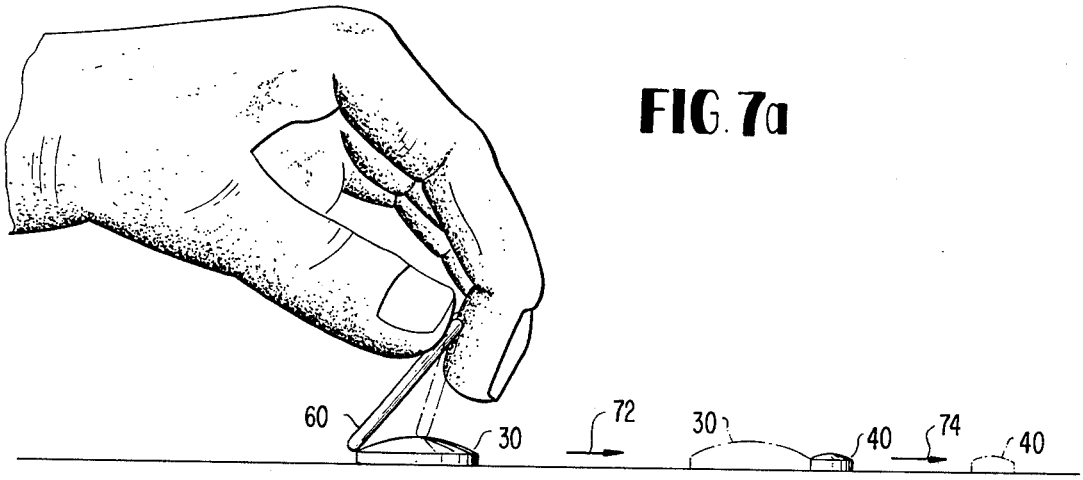
Figure 7B:
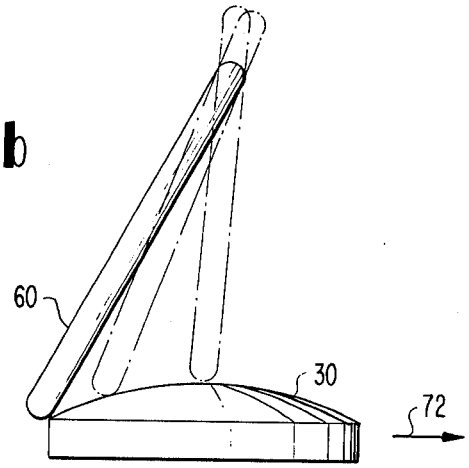

FIGS. 4*a*, 4*b*, and 4*c* are, respectively, a plan view, an elevation view, and a cross-sectional view of a player piece along the line 4—4;

FIGS. 5*a*, 5*b*, and 5*c* are, respectively, a plan view, an elevational view, and a cross-sectional view of a ball piece along the line 5—5;

FIGS. 6*a*, 6*b*, and 6*c* are, respectively, a plan view, an elevation view, and a cross-sectional view of a shooter disc along the line 6—6; and FIGS. 7*a* and 7*b* are elevation views representing the action of a shooter disc, a player piece, and a ball piece.

Referring now to the drawings, wherein like numerals indicate like parts, the board or field layout of this invention is indicated by the numeral 10. The layout is elongated, with a planar surface 11 which can have a plurality of openings 12 formed therein to receive leg members 13 of goals that will hereinafter be described. The board game is surrounded by a peripheral wall 14 slightly higher than the height of the moving members of the game.

Figure 1:
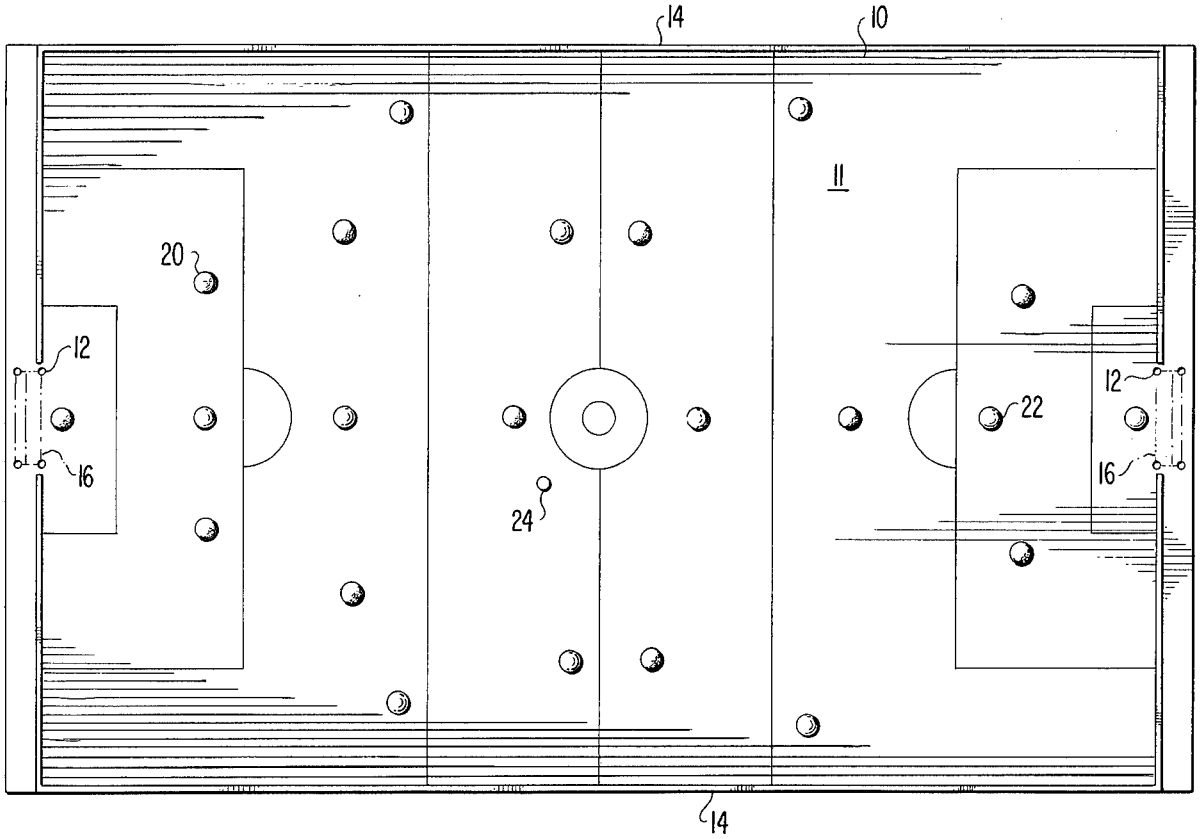
FIG. 1 is a plan view of a board simulating a soccer field.
Figure 2:
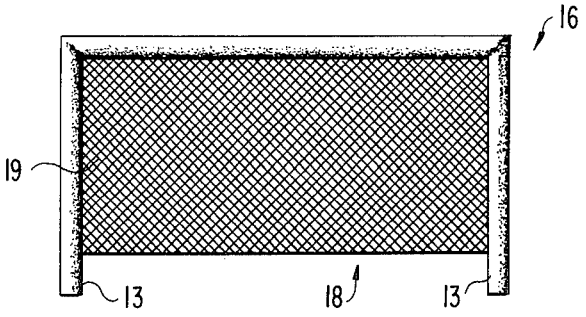
FIG. 2 is a front view of a goal.
Figure 3:
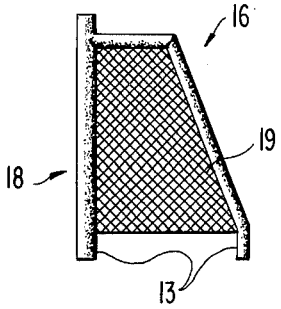
FIG. 3 is a side view of the goal of FIG. 1.

At each end of the elongated board 10 is a goal 16 which can best be seen in FIGS. 2 and 3. The goal has an open front 18 and is closed at its top and back by webbing material 18. The openings of the goals face each other as in regular soccer.

A first set of eleven player chips 20 are disposed in a manner selected by the player who is awarded these player pieces. A second set of eleven player pieces 22 is so arranged at the other goal. A ball chip 24 is disposed on the playing surface. Each member of set 20 is of the same color or pattern and each member of set 22 is of the same color or pattern but distinct from the color of set 20, just as members of soccer teams are clothed. The player who is given set 20 is equipped with a shooter piece 26 having the same color as the pieces 20. The player who is awarded the team set 22 is awarded a second shooter disc having the same color as the team set 22.

An individual player chip 30 is shown in FIGS. 4*a*, 4*b* and 4*c*. The chip is formed of an upstanding edge 32 having a concave upper surface 34. The chip is normally made of metal and is hollow, as seen in the cross-section of 3*a*. The hollowness of the chip reduces friction against the player and the board surface.

The ball chip is similar in design to the player chips but much smaller. A ball chip 40 is shown in FIG. 5*a*. The ball chip is formed with a side wall 42 having a height approximately that of the edge 32. The ball chip has an upper concave surface 43. As can be seen in FIG. 4*c*, the ball chip 40 is also hollow so as to reduce friction against board game surface 10.

A shooter chip 60 is shown in FIGS. 6*a*, 6*b*, and 6*c*. The shooter chip is formed of a relatively, thin, circular member 62 having an enlarged periphery 64 formed with a semicircular outer edge 66.

As seen in FIGS. 7*a* and 7*b*, a player grips the disc 60 between his thumb and forefinger and presses the edge 66 at about the apex of the concave surface 30. By drawing, pressing, and pivoting the chips between his forefingers in the manner shown in FIGS. 7*a* and 7*b*, the player chip 30 will be caused to move in the direction of the arrow 70 and strike the ball chip 40, causing it to move in the direction of the arrow 74.

With practice, a great deal of skill is gained in controlling the movement of the players and the ball, in much the same fashion as skill is developed in billiards. A player in control of the ball retains possession thereof with a series of shots as long as he does not strike the peripheral edge 14 which represents "out of bounds" or one of the opposing players. The skill and excitement of a real soccer game is achieved and the tactics and rules of play are readily learned by players of all ages.

In a general manner, while there has been disclosed an effective and efficient embodiment of the invention, it should be well understood that the invention is not limited to such an embodiment, as there might be changes made in the arrangement, disoposition, and form of the parts without departing from the principle of the present invention as comprehended within the scope of the accompanying claims.

I claim:

1. A game for instructing the rules of soccer by simulating soccer play on a planar surface having a soccer field layout thereon, comprising;

a pair of goals for placement at either end of said soccer field layout, a first set of round player pieces, each of which has a vertical circular side wall and an upper concave surface, said first set comprising a first team, a second set of round player pieces each of which has a vertical, circular side wall the circumference of which is the same as those layer pieces in said first set and each having an upper concave surface, said second set comprising a second team, a circular ball piece having a circumference substantially less than that of said player pieces, first and second shooting discs having a circumference substantially the same as said player pieces and having a relatively thin body and an enlarged semicircular edge about its periphery, whereby first and second players are given, respectively, one of said discs and first and second sets of said players and said players dispose said sets according to their tactics and in accordance with certain game rules and said shooter discs are utilized to slide over said concave surfaces of said players to impel said players with sufficient force to strike said ball piece and move said ball piece toward one of said goals.

2. The game of claim 1 wherein said player pieces are hollow.

3. The game of claim 1 wherein said player pieces are metal.

* * * * *